US006227187B1

(12) United States Patent
Alexander et al.

(10) Patent No.: US 6,227,187 B1
(45) **Date of Patent: *May 8, 2001**

(54) GAS HOLDING CHAMBER FOR AIR-POWERED PAINTBALL GUNS

(76) Inventors: Aaron K. Alexander; Larry G. Alexander, both of 2445 N. Franklin Rd., Indianapolis, IN (US) 46219

( * ) Notice: Subject to any disclaimer, the term of this patent is extended or adjusted under 35 U.S.C. 154(b) by 0 days.

This patent is subject to a terminal disclaimer.

(21) Appl. No.: 09/300,148

(22) Filed: Apr. 27, 1999

Related U.S. Application Data

(63) Continuation of application No. 08/882,672, filed on Jun. 25, 1997, now Pat. No. 5,904,133.

(51) Int. Cl.[7] ..... F41B 11/00
(52) U.S. Cl. ..... 124/71
(58) Field of Search ..... 124/56, 70, 71, 124/72, 74

(56) References Cited

U.S. PATENT DOCUMENTS

| | | | | |
|---|---|---|---|---|
| D. 357,967 | * | 5/1995 | Colby . | |
| 3,633,560 | * | 1/1972 | DeFreitas . | |
| 5,381,778 | | 1/1995 | D'Andrade et al. | 124/73 |
| 5,515,838 | | 5/1996 | Anderson | 124/73 |
| 5,553,598 | * | 9/1996 | Johnson et al. . | |
| 5,586,545 | * | 12/1996 | McCaslin . | |
| 5,727,538 | * | 3/1998 | Ellis . | |
| 5,813,392 | * | 9/1998 | McCaslin . | |
| 5,904,133 | * | 5/1999 | Alexander et al. . | |

* cited by examiner

*Primary Examiner*—Peter M. Poon
*Assistant Examiner*—James S. Bergin
(74) *Attorney, Agent, or Firm*—Woodard, Emhardt, Naughton, Moriarty & McNett

(57) ABSTRACT

An air chamber that increases the volume of air stored inside a paintball gun. An increased volume of air allows the use of low-pressure/high volume valves in the gun.

23 Claims, 3 Drawing Sheets

GAS HOLDING CHAMBER FOR AIR-POWERED PAINTBALL GUNS

RELATED APPLICATIONS

This application is a continuation of application Ser. No. 08/882,672 filed Jun. 25, 1997 which has issued as U.S. Pat. No. 5,904,133.

BACKGROUND

1. Field of Invention

The present invention pertains to paintball guns and more particularly to a gas holding chamber for use with CO2, nitrogen or compressed air powered paintball guns that replaces an existing bolt.

2. Background

Today's high tech paintball guns generally run off of CO2, nitrogen or compressed air as a power source. These power sources require a specific volume of gas or a specific pressure of gas to fire the paintball at the correct velocity. You can use one or the other. Most paintball guns use the higher pressure/low volume method to shoot a paintball. Then, a few years ago, miniature pressure regulators became available for use on paintball guns allowing players to use a lower pressure gas to fire the paintball, thus relying on more volume of air of fire the paintball. But, the pressure never got below 500 psi into the air chamber of the paintball gun because valves at the time were not built for efficiency at low pressures. At the same time paintball pressure regulators become available on the market, manufactures and after-market customizers shortened the paintball guns to reduce weight by cutting off part of the air chamber, thus reducing the amount of stored gas. At that time there was no problem caused by reducing the length of the chamber because high pressure/low volume was being used. But as the newer, more gas efficient air valves that operate on a lower pressure/high volume (ranging from 100 psi to 400 psi) started to become available. The lack of air-chamber space has caused the paintball guns not to be able to shoot the paintball at the proper velocity using a lower pressure/high volume setting less than 500 psi.

What is needed is a reservoir chamber that bolts onto the paintball gun through an existing bolt hole into the air-chamber of the paintball gun thus increasing the chamber's volume capacity to allow paintball guns to use the more efficient lower pressure/high volume air valves. The chamber should not significantly increase the weight or change the balance of the paintball gun and work without modifying the paintball gun by drilling out the air chambers. The air chamber needs to allow air to rush from the reservoir more rapidly through a straight-line passage to the valve; unlike the previous mounting bolt that allows air to enter the gun 90 deg. from the valve and pass through a small hole in the front mounting block bolt thus restricting air flow.

SUMMARY OF THE INVENTION

The present invention accomplishes these objectives by providing a reservoir that can thread into an existing bolt hole on the air chamber of the paintball gun, replacing the old bolt. The air reservoir has threads for the bolt hole, inlet holes to allow air into the air-chamber, a flange to hold an o-ring on the gun to seal air inside, a large chamber space to store a large volume of air, a plug to seal the end of the chamber and provide means of tightening the air reservoir to the gun.

DETAILED DESCRIPTION OF THE PREFERRED EMBODIMENT

Figure 1:
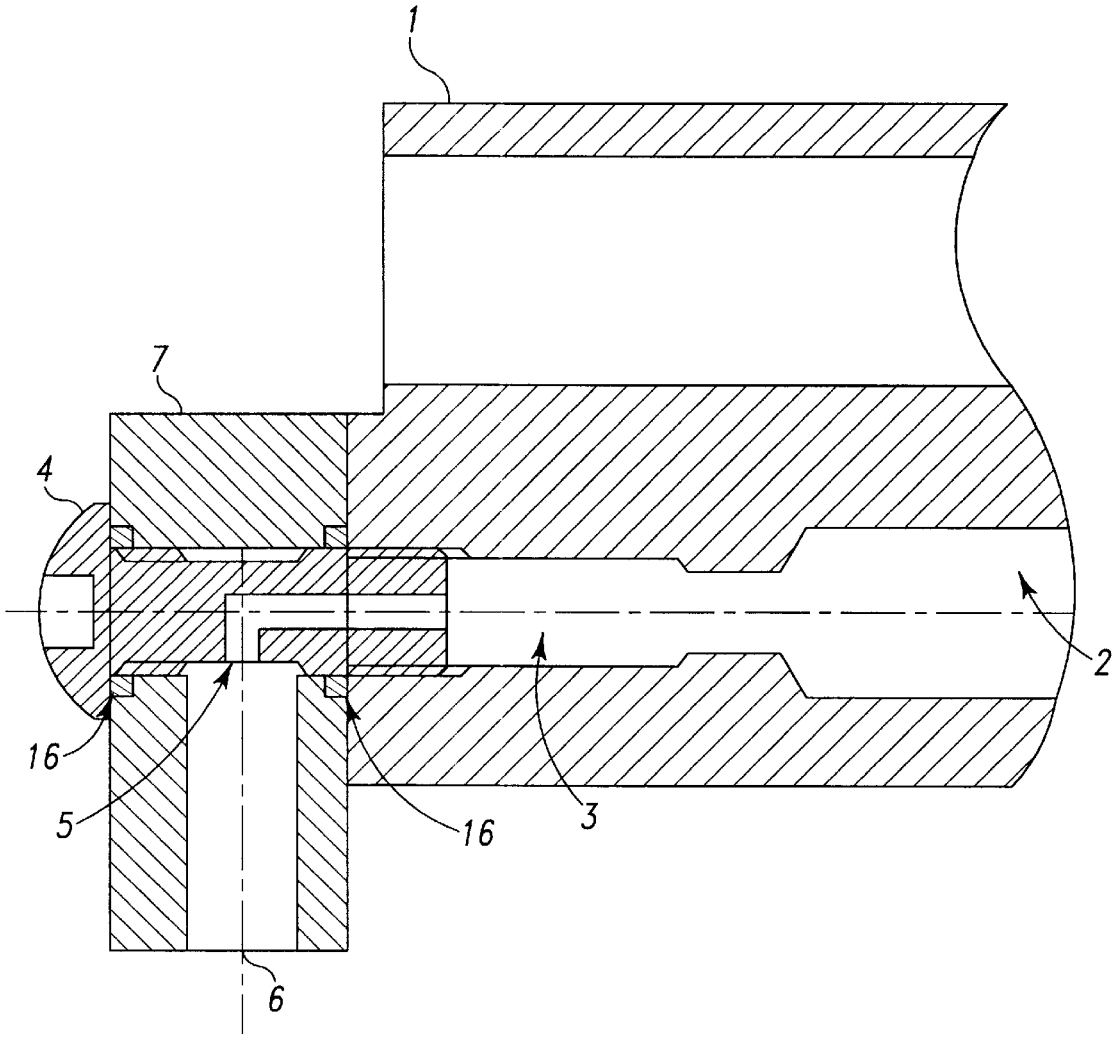
Fig. 1 (PRIOR ART)
FIG. 1: A cross-section view showing the location of the air chamber on the paintball gun and the previous mounting bolt and air inlet.
Figure 2:
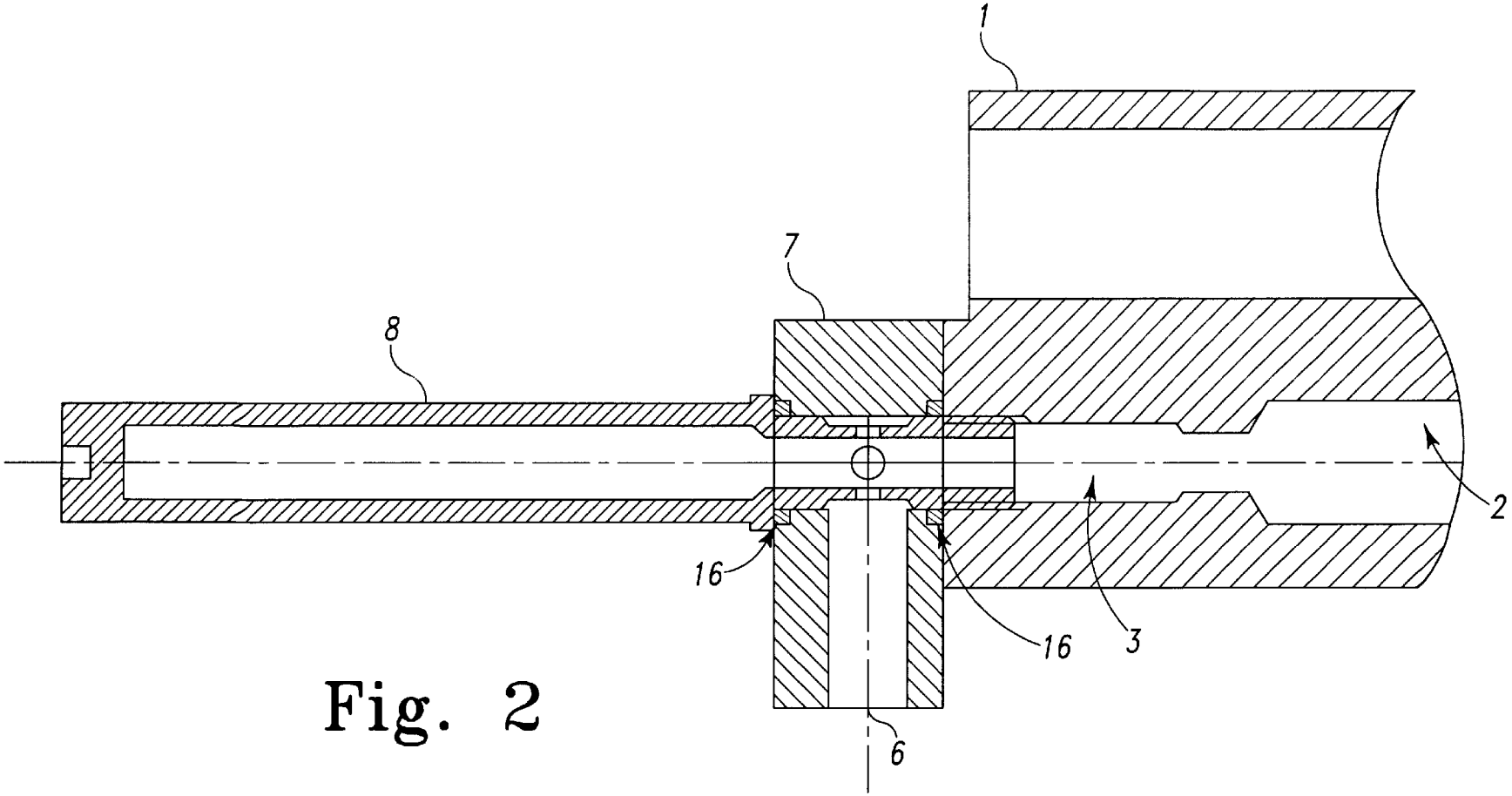
FIG. 2: A cross-section view showing the location of the air chamber on the paintball gun and the air reservoir location in accordance with the present invention.
Figure 3:
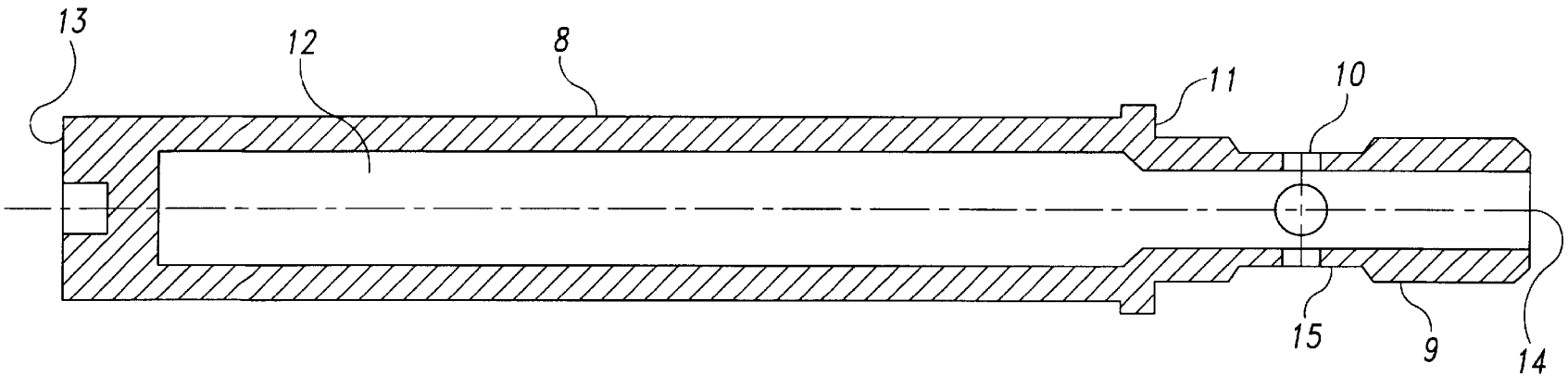
FIG. 3: A cross-section view of the air reservoir for more detailed inspection.

Referring now to FIGS. 1–3 of the accompanying drawings, the air reservoir chamber of the present invention will be described. FIGS. 1 and 2 essentially shows where and how the air reservoir 8 is located in place of the previous bolt 4. The paintball gun body 1 is shown to show location of valve chamber 2 and the air chamber 3 and location of front mounting block 7 and the older design mounting block bolt 4. The front block mounting bolt 4 screws into paintball gun body 1 and has a small air transfer hole 5 to allow air to flow through from air inlet 6 to the air chamber 3. The air transfer hole 5 is small which restricts air flow and reduces performance, so people have to increase air flow through the bolt by drilling the holes larger. That works to increase flow rate but also reduces the strength of the bolt and still does not solve the problem of the reduced chamber space.

For a comparison, FIG. 2 shows the present invention, the air reservoir 8 mounted in the same location as the older front mounting block bolt 4 to pictorially show the increased size of the air chamber.

FIG. 3 shows a cross section view of out present invention, the air reservoir 8 where 9 indicates the threaded end the attaches to the paintball gun body 1 which is shown on FIGS. 1 and 2. A turned down diameter 15 which allows air to flow around the whole diameter and enter through multiple holes 10 and fill the air chamber 3 and the air reservoir chamber 12. A flange 11 has been turned on the air reservoir to secure an o-ring 16 in place and seal air inside and apply pressure to keep the mounting block secured to the paintball gun body 1. The transfer tube 14 has been enlarged over that of the old mounting block bolt 4 which allows air to rush from the air chamber 12 in a straight line path to the air chamber 3 in less time and with less restriction than in previous designs referred to in FIG. 1. The air reservoir also has a plug 13 to seal air inside the reservoir and provide the air reservoir with the means of being tightened down to the paintball gun body.

What is claimed is:

1. A method of modifying an air-powered gun in order to increase a volume of air employed to fire the gun, comprising the steps of:

a) removing a front block mounting bolt from the gun, thereby exposing a threaded mounting hole;

b) providing an air reservoir chamber having a proximal end, a threaded distal end, an air reservoir formed in said chamber, and at least one transfer tube formed in said distal end, said at least one transfer tube communicating with said air reservoir for gas flow therebetween; and c) coupling the threaded distal end of the air reservoir chamber to the threaded mounting hole.

2. The method of claim 1, wherein step (b) further comprises providing an air reservoir chamber comprising:

a chamber body having a longitudinal axis, a proximal end and a distal end;

a threaded surface formed on an exterior of said chamber body at said distal end;

a turned down diameter section formed on said chamber body proximal of said threaded surface;

at least one hole formed from a surface of said turned down diameter section to said longitudinal axis;

an air reservoir formed in said chamber body proximal to said at least one hole and extending substantially along said longitudinal axis, said air reservoir communicating with said at least one hole for gas flow therebetween; and a transfer tube formed in said distal end and extending substantially along said longitudinal axis, said transfer tube communicating with said air reservoir for gas flow therebetween; wherein gas may flow from said air reservoir to said transfer tube in a substantially straight line.

3. An air reservoir chamber adapted to couple a front mounting block to an air-powered gun body, the air reservoir chamber comprising:

a chamber body having a longitudinal axis, a proximal end and a distal end;

an air reservoir formed in said chamber body and extending substantially along said longitudinal axis;

at least one hole formed from a surface of said chamber body to said air reservoir, said air reservoir communicating with said at least one hole for gas flow therebetween; and at least one transfer formed in said distal end and communicating with said air reservoir for gas flow therebetween, wherein gas may flow from said air reservoir to said transfer tube without passing through said at least one hole.

4. The air reservoir chamber of claim 3, further comprising:

a threaded surface formed on an exterior of said chamber body at said distal end.

5. The air reservoir chamber of claim 4, further comprising:

a turned down diameter section formed on said chamber body proximal of said threaded surface.

6. The air reservoir chamber of claim 5, wherein gas may flow from said air reservoir to said transfer tube in a substantially straight line.

7. The air reservoir chamber of claim 3, wherein said at least one hole comprises four holes.

8. The air reservoir chamber of claim 7, wherein said four holes are formed orthogonal to one another.

9. The air reservoir chamber of claim 3, further comprising a plug coupled to said proximal end to seal said air reservoir.

10. The air reservoir chamber of claim 9, wherein said plug is threadedly coupled to said proximal end.

11. A method for modifying an air-powered gun in order to increase a volume of air employed to fire the gun, comprising the steps of:

a) exposing a hole providing access to an interior chamber of the gun;

b) providing an air reservoir chamber having a proximal end, a distal end, an air reservoir formed in said chamber, at least one hole formed from a surface of said chamber body to said air reservoir, said air reservoir communicating with said at least one hole for gas flow therebetween, and at least one transfer tube formed in said distal end, said at least one transfer tube communicating with said air reservoir for gas flow therebetween, wherein gas may flow from said air reservoir to said transfer tube without passing through said at least one hole; and c) coupling said distal end of said air reservoir chamber to the hole, wherein said at least one transfer tube couples said air reservoir and said interior chamber of the gun for gas flow therebetween.

12. The method of claim 11, wherein step (b) further comprises providing an air reservoir chamber comprising:

a chamber body having a longitudinal axis, a proximal end and a distal end;

a threaded surface formed on an exterior of said chamber body at said distal end;

a turned down diameter section formed on said chamber body proximal of said threaded surface;

at least one hole formed from a surface of said turned down diameter section to said longitudinal axis;

an air reservoir formed in said chamber body proximal to said at least one hole and extending substantially along said longitudinal axis, said air reservoir communicating with said at least one hole for gas flow therebetween; and a transfer tube formed in said distal end and extending substantially along said longitudinal axis, said transfer tube communicating with said air reservoir for gas flow therebetween; wherein gas may flow from said air reservoir to said transfer tube in a substantially straight line.

13. An air reservoir chamber adapted to couple to an air-powered gun body, the air reservoir chamber comprising:

a chamber body having a distal end;

a threaded surface formed on an exterior of said chamber body at said distal end;

a turned down diameter section formed on said chamber body proximal of said threaded surface;

an air reservoir formed in said chamber body;

at least one hole formed into a surface of said turned down diameter and communicating with said air reservoir for gas flow therebetween;

at least one transfer tube formed in said distal end and communicating with said air reservoir for gas flow therebetween; and at least one sealing member disposed between said chamber body and the gun body.

14. The air reservoir chamber of claim 13, wherein said chamber body has a longitudinal axis and wherein said air reservoir extends substantially along said longitudinal axis.

15. The air reservoir chamber of claim 14, wherein said at least one transfer tube comprises on transfer tube extending substantially along said longitudinal axis, wherein gas may flow from said air reservoir to said one transfer tube in a substantially straight line.

16. The air reservoir chamber of claim 13, wherein said at least one hole comprises four holes.

17. The air reservoir chamber of claim 16, wherein said four holes are formed orthogonal to one another.

18. The air reservoir chamber of claim 13, wherein said chamber body has a proximal end opposite said distal end and further comprising a plug coupled to said proximal end to seal said air reservoir.

19. The air reservoir chamber of claim 18, wherein said plug is threadedly coupled to said proximal end.

20. The air reservoir chamber of claim 13, wherein said at least one sealing member comprises at least one O-ring seal.

21. A method of modifying an air-powered gun in order to increase a volume of air employed to fire the gun, comprising the steps of:

a) identifying a passage in the gun operative to supply compressed air to an interior chamber of the gun;

b) creating an opening from an exterior of the gun into said passage;

c) providing an air reservoir chamber having a proximal end, a distal end, an air reservoir formed in said chamber, at least one hole formed from a surface of said chamber body to said air reservoir, said air reservoir communicating with said at least one hole for gas flow therebetween, and at least one transfer tube formed in said distal end, said at least one transfer tube communicating with said air reservoir for gas flow therebetween, wherein gas may flow from said air reservoir to said transfer tube without passing through said at least one hole; and d) coupling said air reservoir chamber to said opening such that gas may flow between said air reservoir and said interior chamber.

22. The method of claim 21, wherein step (c) further comprises providing an air reservoir chamber comprising:

a chamber body having a longitudinal axis, a proximal end and a distal end;

a threaded surface formed on an exterior of said chamber body at said distal end;

a turned down diameter section formed on said chamber body proximal of said threaded surface;

at least one hole formed from a surface of said turned down diameter section to said longitudinal axis;

an air reservoir formed in said chamber body proximal to said at least one hole and extending substantially along said longitudinal axis, and air reservoir communicating with said at least one hole for gas flow therebetween; and a transfer tube formed in said distal end and extending substantially along said longitudinal axis, said transfer tube communicating with said air reservoir for gas flow therebetween; wherein gas may flow from said air reservoir to said transfer tube in a substantially straight line.

23. An air-powered gun, comprising:

a gun body;

a front mounting block;

an air reservoir chamber coupling said front mounting block to said gun body, said air reservoir chamber comprising:

a chamber body having a longitudinal axis, a proximal end and a distal end;

an air reservoir formed in said chamber body and extending substantially along said longitudinal axis;

at least one hole formed from a surface of said chamber body to said air reservoir, said air reservoir communicating with said at least one hole for gas flow therebetween; and at least one transfer tube formed in said distal end and communicating with said air reservoir for gas flow therebetween, wherein gas may flow from said air reservoir to said transfer tube without passing through said at least one hole.

* * * * *